US005720405A

United States Patent [19]

Karpisek

[11] Patent Number: 5,720,405

[45] Date of Patent: Feb. 24, 1998

[54] COLLAPSIBLE PALLET WITH SIDE WALLS HINGED TO THE BASE BY LINKS

[76] Inventor: Ladislav Stephan Karpisek, 86 Woodfield Boulevarde, Caringbah, New South Wales 2229, Australia

[21] Appl. No.: 750,341

[22] PCT Filed: Mar. 22, 1996

[86] PCT No.: PCT/AU96/00158

§ 371 Date: Nov. 19, 1996

§ 102(e) Date: Nov. 19, 1996

[87] PCT Pub. No.: WO96/29254

PCT Pub. Date: Sep. 26, 1996

[30] Foreign Application Priority Data

Mar. 22, 1995 [AU] Australia ..... PN2009
Apr. 12, 1995 [AU] Australia ..... PN2378

[51] Int. Cl.[6] ..... B65D 21/00
[52] U.S. Cl. ..... 220/6; 220/7
[58] Field of Search ..... 220/6, 7

[56] References Cited

U.S. PATENT DOCUMENTS

| | | | |
|---|---|---|---|
| 2,456,419 | 12/1948 | Jackson et al. | 220/6 |
| 2,756,894 | 7/1956 | Phillips | 220/6 |
| 2,914,210 | 11/1959 | Paston | 220/6 |
| 3,383,003 | 5/1968 | Schurch | 220/6 |
| 4,186,841 | 2/1980 | Buckley et al. | 220/6 |
| 4,662,532 | 5/1987 | Anderson et al. | 220/6 X |
| 4,735,330 | 4/1988 | Hoss | 220/7 X |

FOREIGN PATENT DOCUMENTS

| | | |
|---|---|---|
| 1945734 | 10/1935 | Australia . |
| 2375588 | 4/1989 | Australia . |
| 3875193 | 12/1993 | Australia . |
| 7598794 | 5/1995 | Australia . |
| 2669894 | 6/1992 | France . |
| 1221958 | 7/1966 | Germany . |
| 2139147 | 2/1973 | Germany . |
| 4218408 | 12/1992 | Germany . |
| 2242891 | 10/1991 | United Kingdom . |
| 9323315 | 11/1993 | WIPO . |
| 9509110 | 4/1995 | WIPO . |

*Primary Examiner*—Steven M. Pollard
*Attorney, Agent, or Firm*—Edwin D. Schindler

[57] ABSTRACT

A collapsible container with four side panels (15, 16, 17, 18) all at least semi-permanently connected to a base (10) by links (11, 41) allowing the panels (15, 16, 17, 18) to be moved between an upstanding condition on the base (1) where they are retained by engagement of bottom panel flanges (40) with channels (13, 14) on the base (10) and can be coupled by coupling means (19, 23) releasably secured by securing means (21, 22) to a collapsed condition by folding down the pannels (15, 16, 17, 18) into an overlying relationship. The link means (FIGS. 4–6) allowing the panels to move normally to their plane to disengage the flanges with the channels and then to pivot inwards to a horizontal position.

8 Claims, 8 Drawing Sheets

FIG. 4.
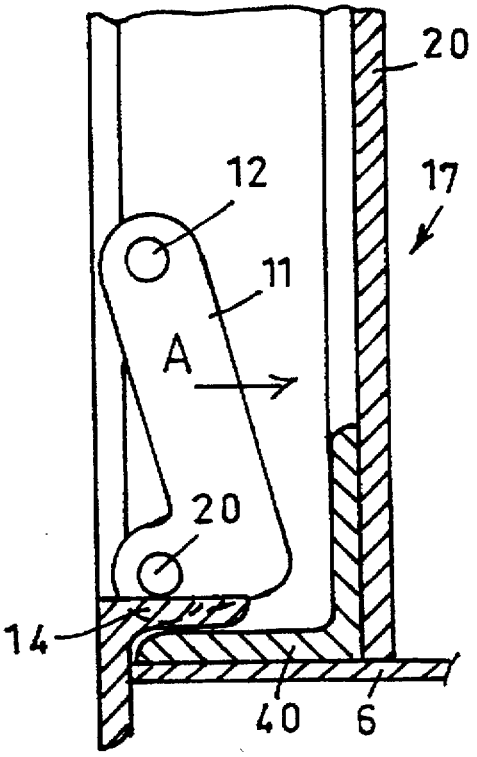
FIG. 5.
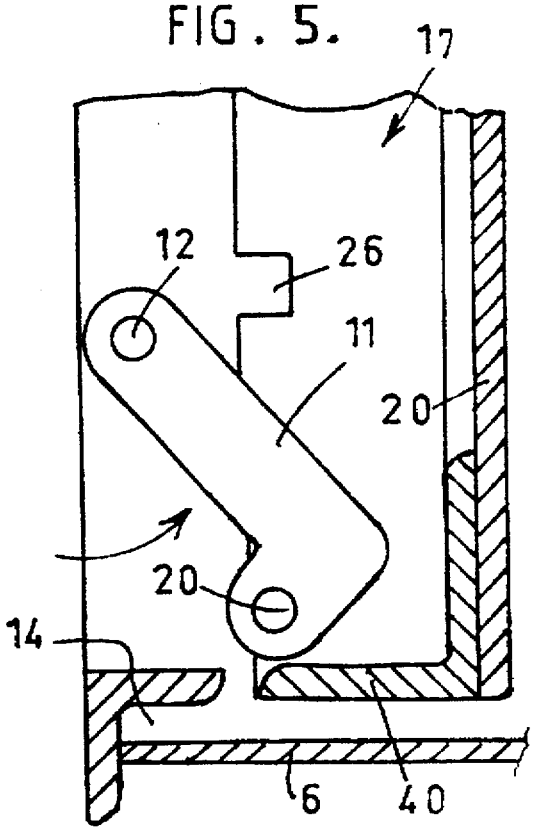
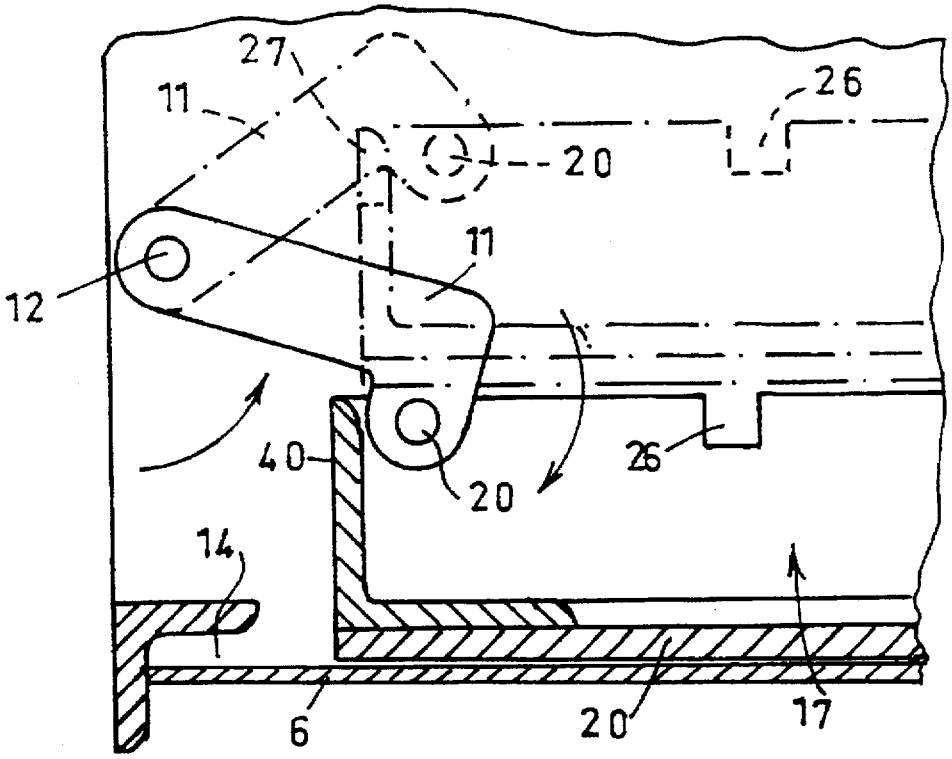
FIG. 6.

COLLAPSIBLE PALLET WITH SIDE WALLS HINGED TO THE BASE BY LINKS

FIELD OF THE INVENTION

This invention relates to collapsible containers.

BACKGROUND TO THE INVENTION

Collapsible containers of many forms are known. One form has a base with demountable side panels. Another form has a base with coupled side panels which can be folded down to overlying relationship one with the other and all in overlying relationship with the base. To this time the folding down and erection of the panels relative to the base in containers of the latter type has been handicapped by the construction of the connections between the panels and the base. This invention proposes a novel form of connection which, in association with the means used for engaging the panels when upright with the base, provides a simple and effective alternative to the known arrangements used in containers having a base with permanently coupled fold down side panels.

STATEMENT OF INVENTION

Broadly stated the invention provides a collapsible container including a four sided base, two pairs of container side panels with the panels respectively permanently connected by link means to the base adjacent the four sides thereof, the height of the panels of one pair between a bottom edge and a top edge of each panel being shorter than the height of the panels of the other panel pair, the width of the panels of said shorter pair between side edges joining the top and bottom edges thereof being greater than the width of the panels of the longer pair, channels at the four sides of the base and flanges on the bottom edges of the panels, said link means permitting said panels when upright with respect to said base to move divergently in directions normal to the planes of said panels to achieve engagement of said panel flanges in said base channels and also permitting said panels after disengagement of said panel flanges from said base channels to move pivotally to allow said panels to be stacked in overlying relationship with each other and said base, releasable coupling means to couple together adjacent sides edges of the panels of said panel pairs when upright with respect to said base and connected by said flanges to said base channels and releasable securing means to prevent release of said coupling means.

GENERAL DESCRIPTION OF THE DRAWINGS

Preferred embodiments of the invention will now be described with reference to the accompanying drawings in which;

FIG. 1 is a perspective view of a base for a first form of the invention,

FIG. 2 is a perspective view of one pair of panels for use with the base of FIG. 1, FIG. 3 is a perspective view of a container utilising the base of FIG. 1 and two pairs of panels as shown in FIG. 2, FIG. 4 is an enlarged fragmentary view of the link components for the link connection between the base and a panel, with the panel upright in an operative relationship with panel mounting means of the base, FIG. 5 is a view similar to FIG. 4 where the panel is disengaged from its mounting means but still erect, FIG. 6 is a view similar to FIG. 4 where the panel is disengaged from its mounting means but folded down as part of the container collapsing process, FIG. 7 diagrammatically shows a first stage in the collapse of the container, FIG. 8 is a view similar to FIG. 7 showing the second stage in the collapse of the container, FIG. 9 is a view similar to FIG. 7 showing the third stage in the collapse of the container, FIG. 10 shows the container collapsed, FIG. 11 is an enlarged fragmentary view of alternative link components for linking a panel to the base of a container, FIG. 12 is a view similar to FIG. 11 with the link components assembled, FIG. 13 is an enlarged fragmentary view of the link connection of FIG. 12 between the base and a panel with the panel in an upright operative relationship with means to couple the panel to the base, FIG. 14 is a view similar to FIG. 15 where the panel is disengaged from its coupling means but still erect, and FIG. 15 is a view similar to FIG. 14 where the panel is disengaged from its coupling means but folded down to an overlying relationship with the base.

DETAILED DESCRIPTION OF THE ILLUSTRATED PREFERRED EMBODIMENTS OF THE INVENTION

Figure 1:
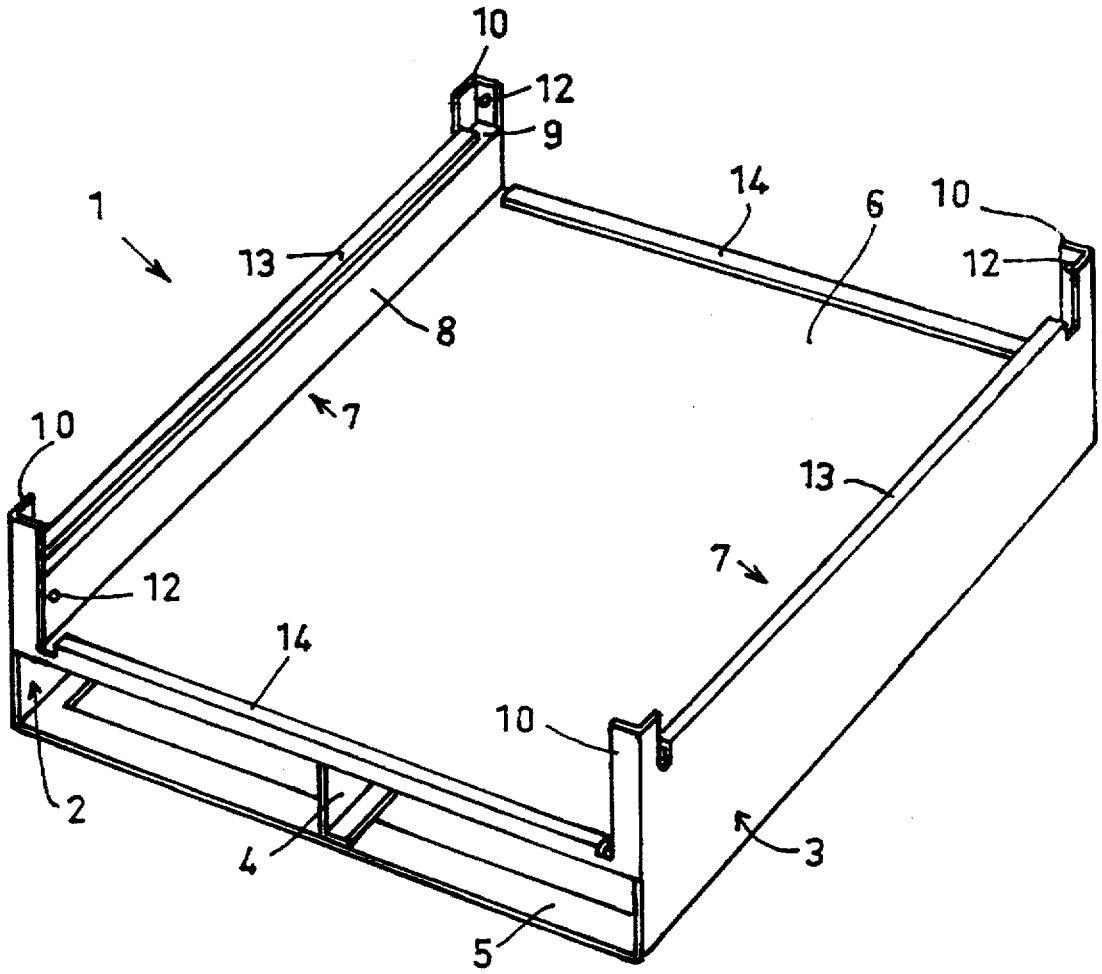

The container base 1 of FIG. 1 is made of metal and includes elements making it a 'pallet type' base for the container of the present invention. It is to be understood that the base need not be of the pallet type. The base 1 has two parallel sides 2,3 and a bearer 4 therebetween. The bottom edges of the sides 2,3 and the bearer 4 are connected by several transverse battens 5, only one of which is shown in FIG. 1. A load supporting floor panel 6 is provided. The sides 2,3 above the floor panel 6 are parts of box sections forming rails 7 each with an inner skin 8 and a top 9.

Extending the length of each rail top 9 there is a strip spaced above the rail top 9 to form channels 13 and there are like strips located at the edges of the base between the rails 7 to provide channels 14. At each corner of the base there are upstanding angle legs 10 forming part of the rails 7.

Figure 2:
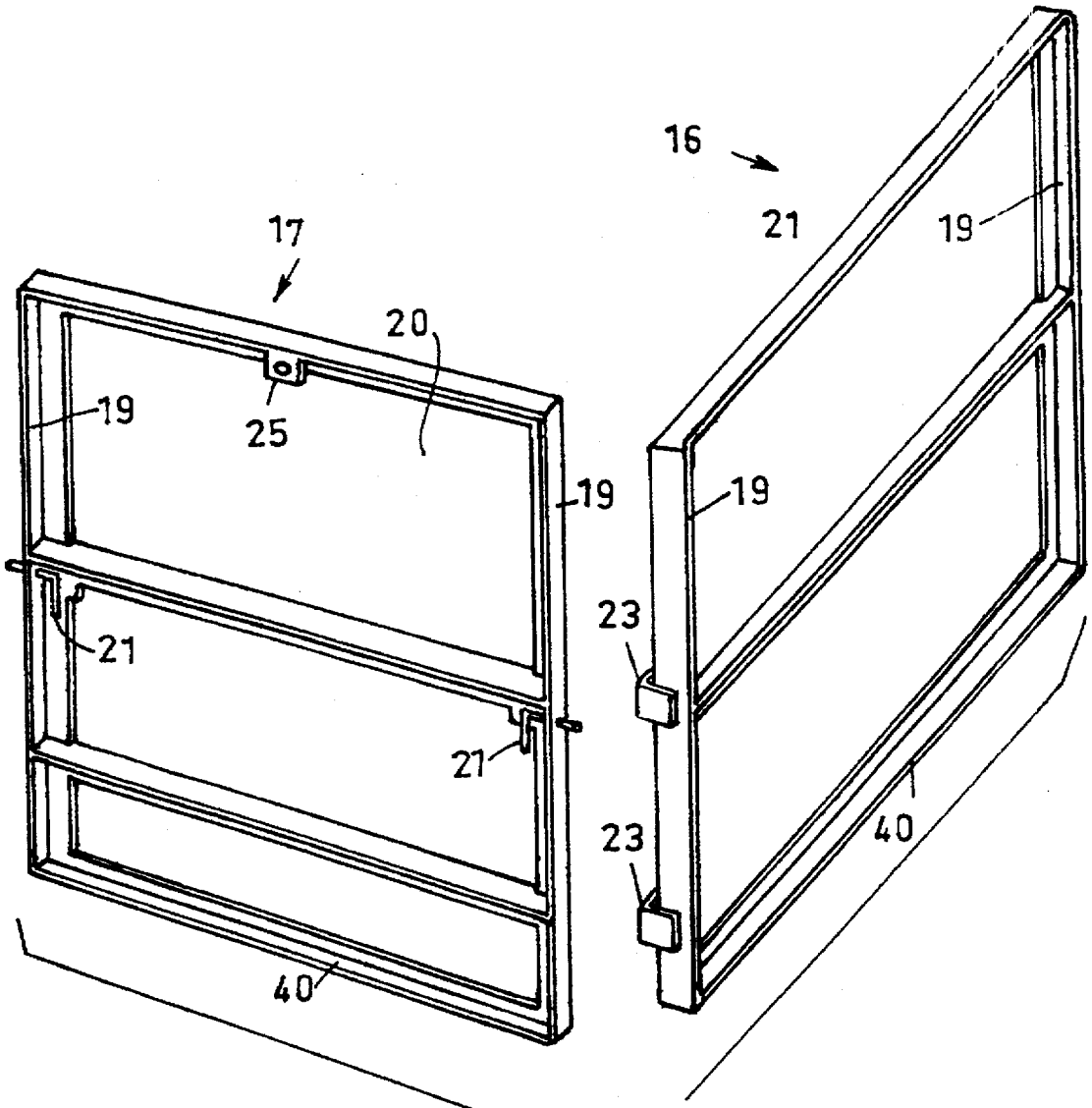

Four panels are permanently coupled to the base 1 by link means, best seen in FIGS. 4 to 6. The panels are in pairs with oppositely disposed panels 15,16 of one pair coupled by links 11 to the legs 10 and the panels 17,18 are oppositely disposed and are coupled to the inner skins 8 of the rails 7 by like links 11. Each panel is preferably formed from a frame of angle iron members with out-turned flanges and an attached inner cladding sheet 20. It is to be noted that the panels 15,16 have a height less than that of the panels 17,18 for reasons which will become clear from the following detailed description. As will be seen from FIG. 2 the panel 17 is provided with slide bolts 21 for engagement in holes 22 in the frames of the panels 15,16. The side bolts 21 (provided on both panels 17 and 18) and the holes 22 provide securing means, as will be later described.

Figure 3:
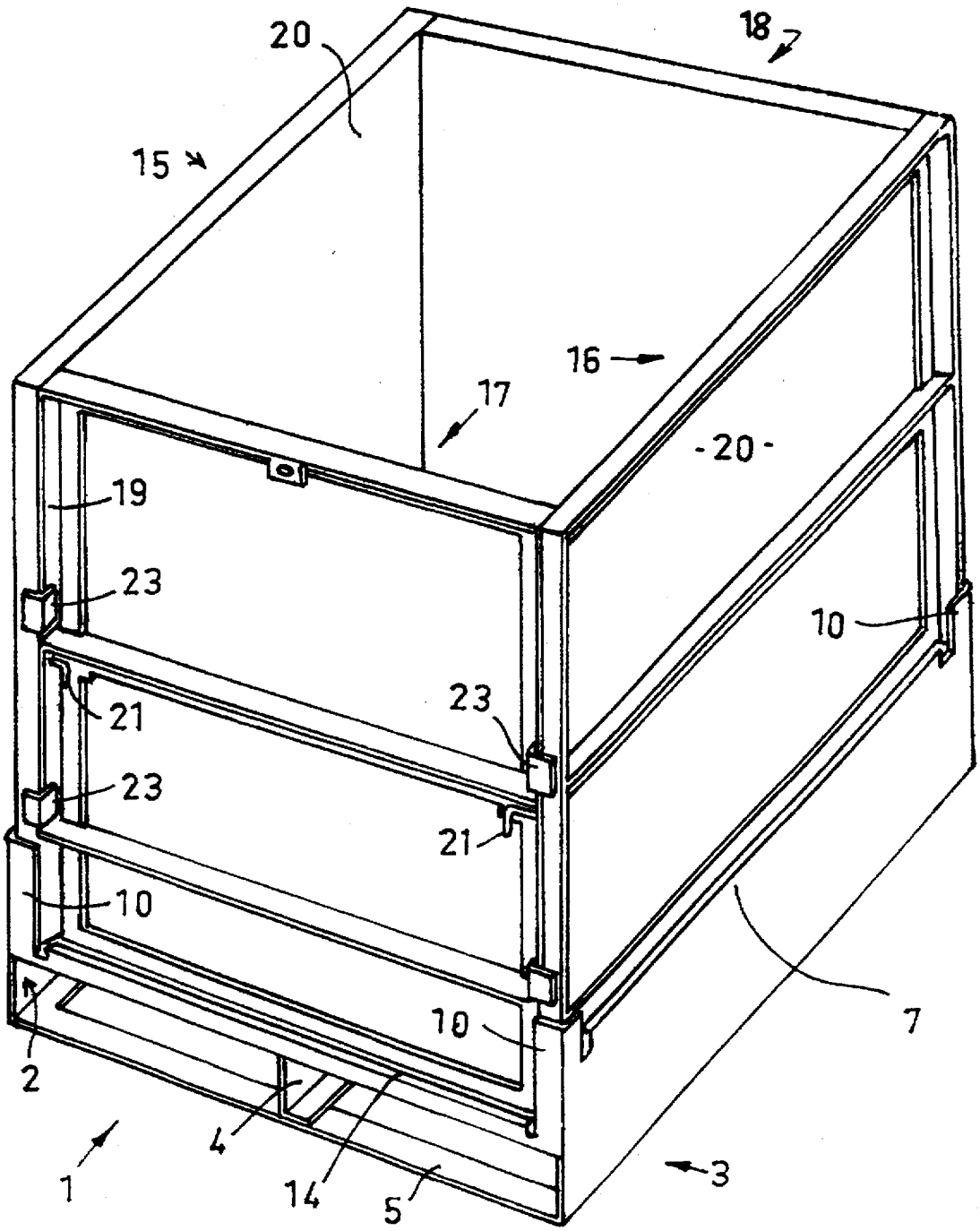

The container in an erected condition is shown in FIG. 3 where the flanges 19 of the upright sides of the panels 17 (and 18) are engaged with the hooks 23 to provide a coupling means for the erected panels. Securing means to secure the panels in coupled relationship is provided by entry of the slide bolts 21 into the holes 22.

Figure 10:
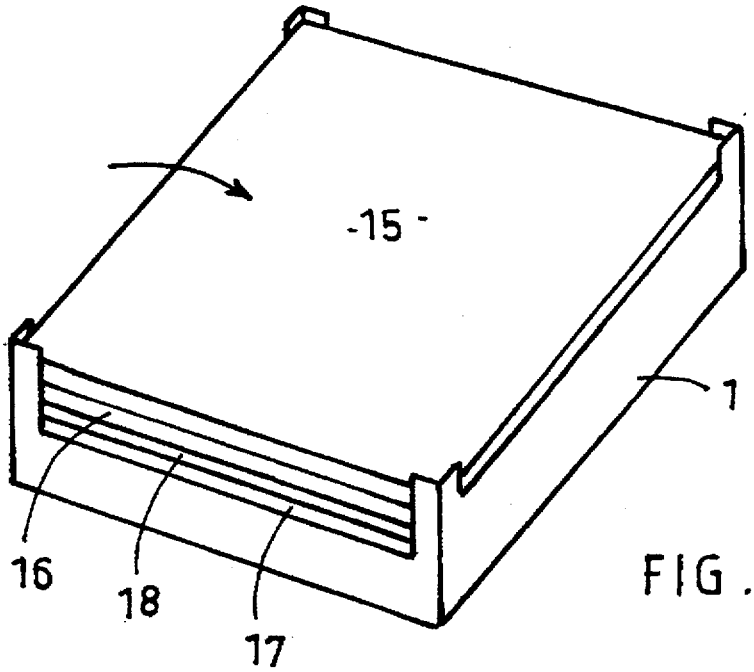
Figure 11:
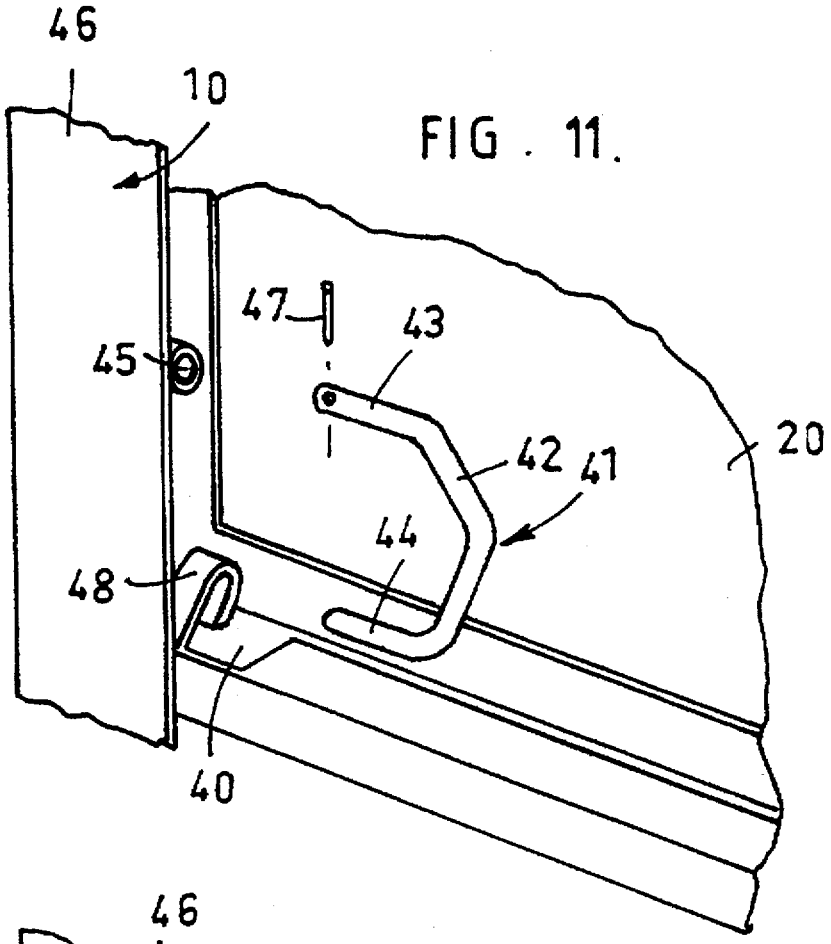

The collapsed condition of the container is shown in FIG. 10 with the panels folded down and in overlying relationship, each with the other and all with respect to the base 1. This relationship is made possible by the links 11. The function of the links 11 as part of the folding and erecting process for the panels will now be described with reference to FIGS. 4 to 6.

In the panel erected condition the flange 40 of the bottom frame member of the side 17 is engaged in the channel 14. The links 11 at the opposite edges of the panel 17 are top connected to pins 12 on the inner skin 8 of the rails 7 and are bottom connected to the pins 20 on opposite upright side edges of the panel 17, see FIG. 4. In a typical panel collapsing sequence the panel 17 is first moved in the direction of the arrow A, normal to the plane of the panel, with arcuate movement of the link 11 about the two pivot pins 12 and 20. In the case of the panels 15 and 16 the pins 12 are fixed to the legs 10. FIG. 5 shows the panel 17 withdrawn so the panel bottom flange 40 is free of the channel 14. The notch 26 in the panel upright houses the pin 12 when the panel is in the FIG. 4 position.

FIG. 6 illustrates the arrangement of the components when the panel 17 is folded down (full lines) and when tilted and raised (broken lines) ready for lowering to the full line position or as will be the elevation of the opposite panel 18 when it is folded down to overlie the panel 17.

Figure 7:
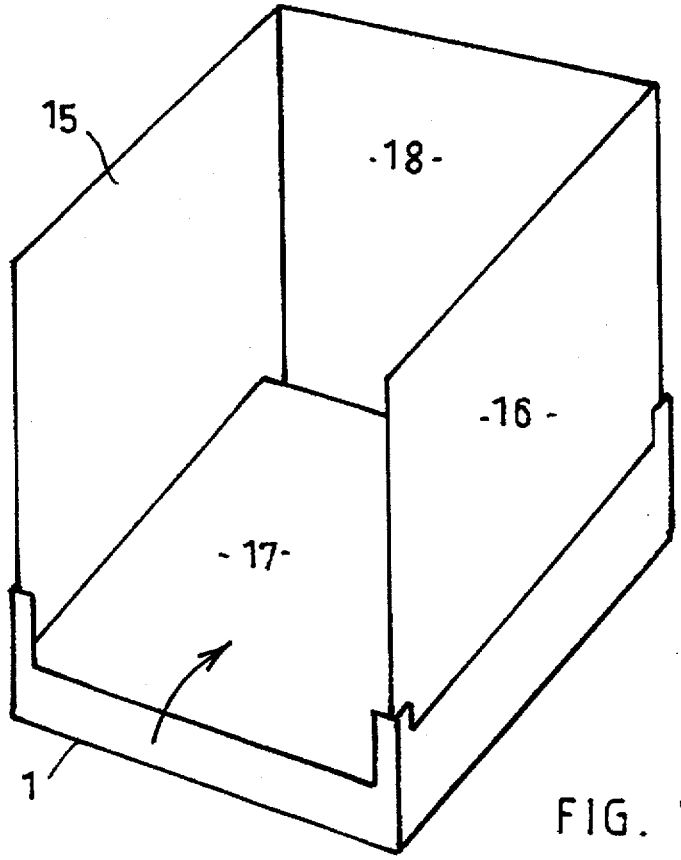
Figure 8:
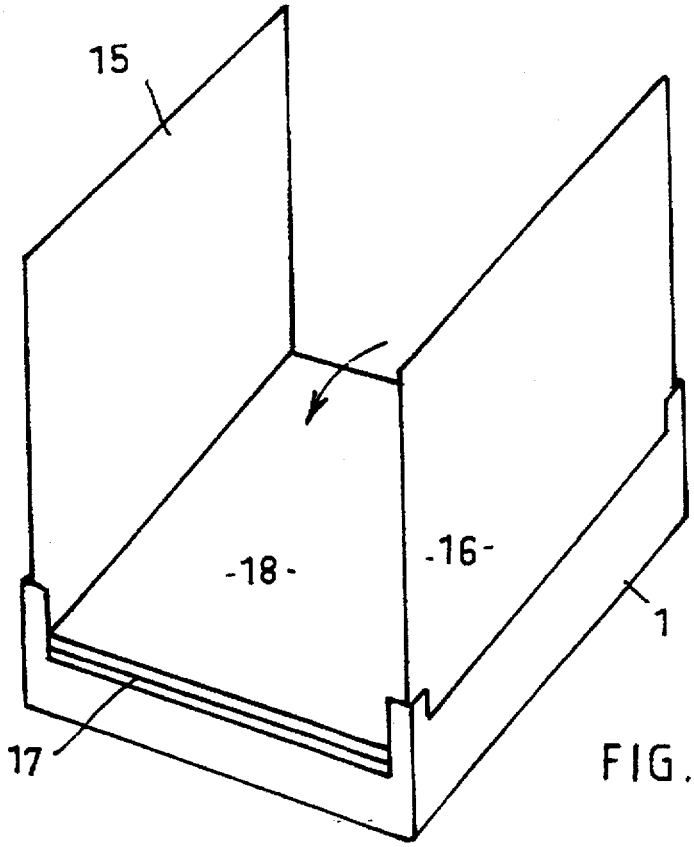
Figure 9:
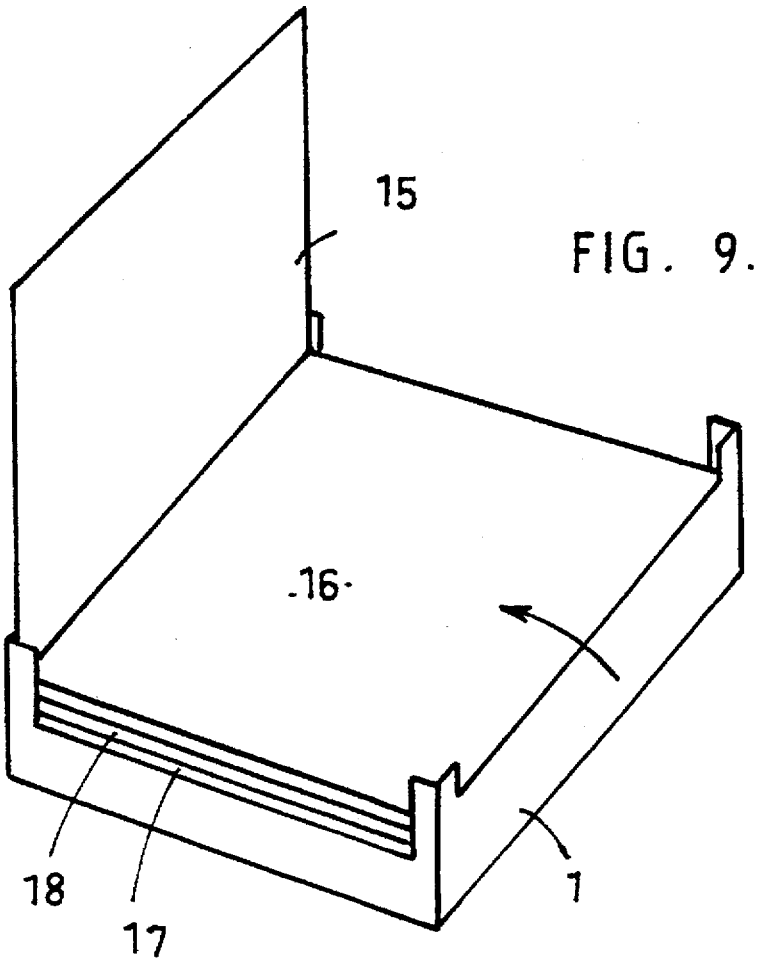

By following the folding down sequence of FIGS. 4 to 6 in the sequence shown in FIGS. 7 to 9 the collapsed configuration of FIG. 10 can be achieved. The security of the connection of the panels to the base and the simplicity of the erection and collapsing sequences can be readily seen from the drawings provided.

Where a lid is required a suitable lid can be designed to co-operate with the panels of the container and to that end the bracket 25 with a hole therein is shown on the top rail of the panel 17 in FIG. 3.

Whilst an "L" shaped link is shown a straight link can be used. In the case of a straight link the link accommodating notch 27 in the flange 40 of the panel 17 would have to be deeper than that shown in FIG. 6 for use with an "L" shaped link 11.

Figure 12:
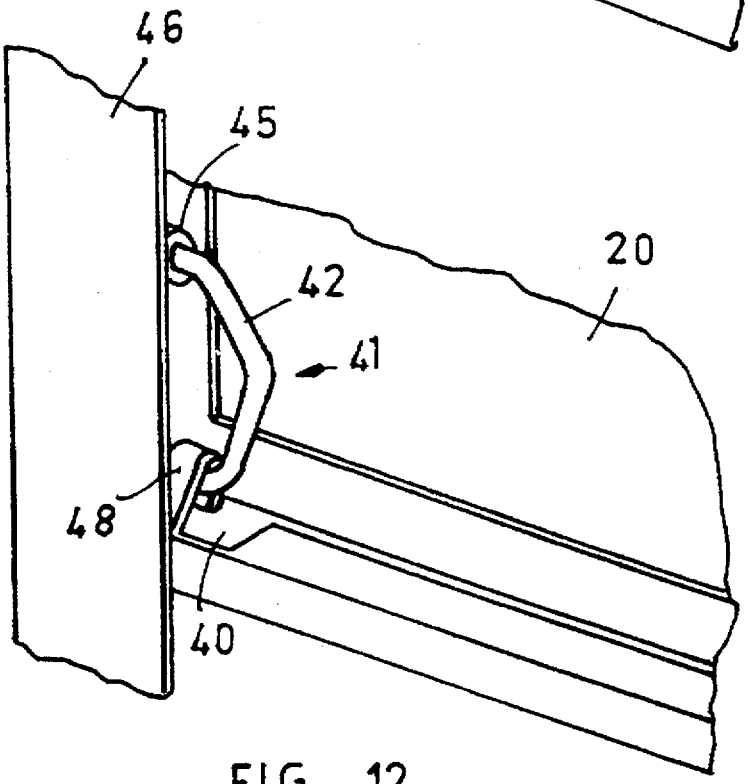

Reference is now made to FIGS. 11 to 15 illustrating a second form of linkage for connecting the panel 17 to the base. As illustrated the link alternative to the link 11 is a link 41 with an elongated bent body 42 made from round cross-section rod with a top and bottom out turned parallel spigots 43 and 44. As shown in FIG. 12 the link leg 43 is pivotally housed in a socket 45 on the limb 46 of the base leg 10, which is widened to accommodate the socket 45, where it is retained by a pin 47. The link leg 44 is housed in an elongated saddle 48 in which it can pivot and slide, the saddle 48 is fixed to the bottom flange 40 of the panel 17.

Figure 13:
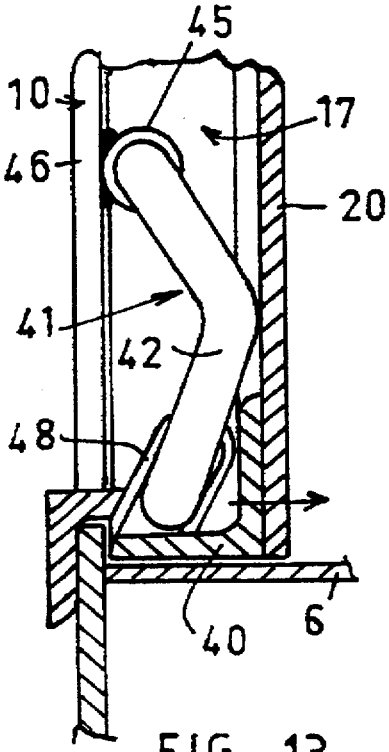

As shown in FIG. 13, in a panel folding sequence the panel 17 is first moved in the direction of the arrow A with arcuate movement of the link spigot 43 in the socket 45 and the link spigot 44 in the elongated saddle 48. A similar arrangement are provided for the panels 15, 16 and 18. In the case of the panels 17 and 18 the sockets 45 could be replaced by spigot supporting holes in the skins 8 of the rails 7, and the spigot 43 may be long enough to extend right through the rails 7.

Figure 14:
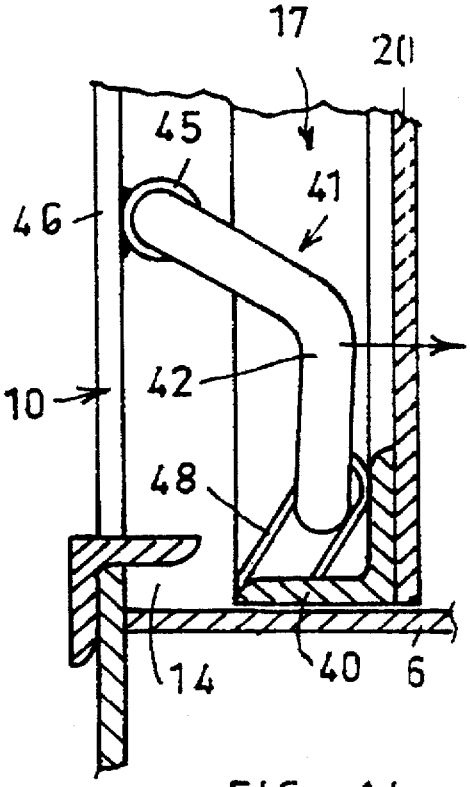
Figure 15:
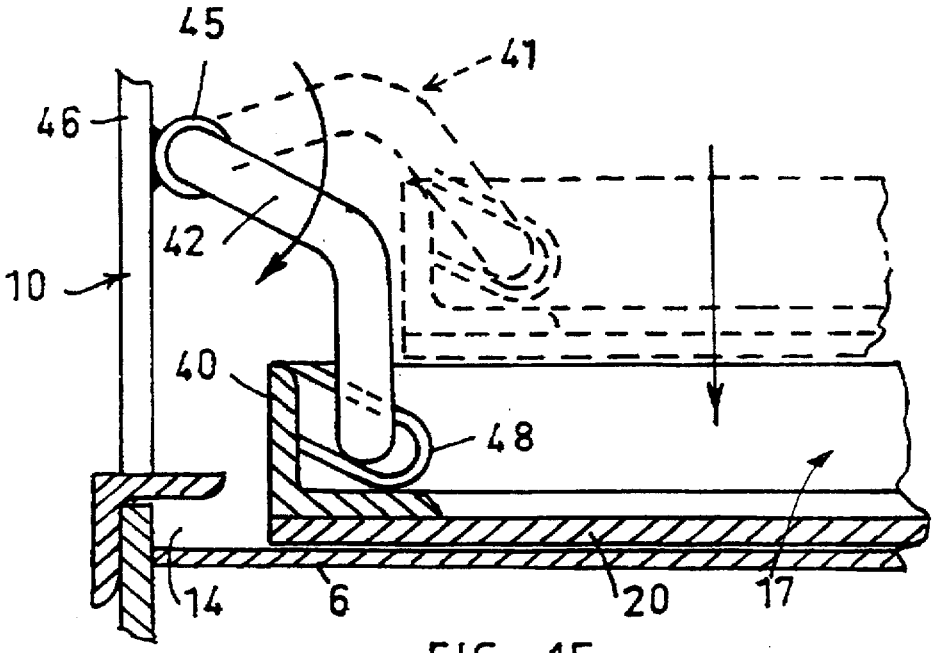

FIG. 14 shows the panel flange 40 withdrawn from the channel 14 so the bottom rail of the panel is free of the channel and rests on the floor panel 6 as a result of the movement of the link pivot 44 along the opening in the saddle 48. This movement also allows the panel 17 to be folded down flat onto the panel 6 as shown in full lines in FIG. 15. The dotted outline is of the panel 17 prior to lowering into overlying relationship with the panel 6 and also represents the elevation of the panel 18 when folded down onto the panel 17.

The panel erection procedure is generally as shown in FIGS. 10 through 7 and individually as shown in FIGS. 6 through 4, and FIGS. 15 through 13.

The foregoing is a presently preferred embodiment of the invention and it is to be understood that non-inventive changes can be made to the manner of constructing the panels and the base without departing from the inventive concept hereinbefore disclosed and hereinafter claimed.

I claim:

1. A collapsible container including a four sided base, two pairs of container side panels with the panels respectively permanently connected by link means to the base adjacent the four sides thereof, the height of the panels of one panel pair between a bottom edge and a top edge of each panel being shorter than the height of the panels of the other panel pair, the width of the panels of said shorter pair between side edges joining the top and bottom edges thereof being greater than the width of the panels of the longer pair, channels at the four sides of the base and flanges on the bottom edges of the panels, said link means permitting said panels when upright with respect to said base to move divergently in directions normal to the planes of said panels to achieve engagement of said panel flanges in said base channels and also permitting said panels after disengagement of said panel flanges from said base channels to move pivotally to allow said panels to be stacked in overlying relationship with each other and said base, releasable coupling means to couple together adjacent sides edges of the panels of said panel pairs when upright with respect to said base and connected by said flanges to said base channels and releasable securing means to prevent release of said coupling means.

2. A container as claimed in claim 1 wherein the base channels at two opposed sides of said base are at an elevation above the channels at the other sides of the base with the difference in elevation between said channels substantially the same as the difference in height between the panels of said panel pairs.

3. A container as claimed in claim 2 wherein channels at the higher elevation are parts of rails upstanding from a load supporting surface of said base at opposed sides of said base and the link means for each of said shorter panels includes two links pivotally connected at first ends to one of said rails and pivotally connected at second ends to the side edges of said shorter panels, and the channels at the lower elevation are at said support surface and the link means for each panel of the panel pair of greater height includes two links pivotally connected at first ends one to each of said rails and pivotally connected at second ends to the side edges of said panels of greater height.

4. A container as claimed in claim 3 wherein each of said links includes an elongated body with parallel end spigots respectively engaged in a bearing fixed to said base and pivotally and slidably movable in a slot of a saddle member fixed to a panel.

5. A container as claimed in claim 3 wherein each of said links includes an elongated body with end apertures to receive pivot pins fixed to said base and a panel.

6. A container as claimed in claim 1 wherein the releasable coupling means includes hooks on the side edges of said panels of shorter height engagable by flanges on the side edges of the panels of greater height the engagement thereof preventing separating movement of the top edges of said panels when upright with respect to said base.

7. A container as claimed in claim 6 wherein said releasable securing means prevent disengagement of the flanges on the sides edges of the panels of greater height from said hooks.

8. A container as claimed in claim 7 wherein the releasable securing means comprises slide bolts on the panels of greater height engagable in apertures in the panels of shorter height.

* * * * *